US007007363B2

(12) United States Patent
Forbis

(10) Patent No.: US 7,007,363 B2
(45) Date of Patent: Mar. 7, 2006

(54) METHOD FOR ATTACHING A FENCE RAIL TO A SUPPORT

(75) Inventor: John T. Forbis, York, NE (US)

(73) Assignee: Kroy Building Products, Inc., Cary, NC (US)

( * ) Notice: Subject to any disclaimer, the term of this patent is extended or adjusted under 35 U.S.C. 154(b) by 0 days.

(21) Appl. No.: 10/824,707

(22) Filed: Apr. 14, 2004

(65) Prior Publication Data

US 2004/0195559 A1 Oct. 7, 2004

Related U.S. Application Data

(62) Division of application No. 10/277,721, filed on Oct. 21, 2002, which is a continuation of application No. 10/138,722, filed on May 3, 2002, now abandoned.

(60) Provisional application No. 60/288,359, filed on May 3, 2001.

(51) Int. Cl.
*B23P 11/00* (2006.01)

(52) U.S. Cl. ..... 29/428; 29/897.31; 256/66.04

(58) Field of Classification Search ..... 29/428, 29/897, 897.3, 897.31, 897.33, 7.1, 235, 29/469, 453, 517; 256/65.04, 65.05, 65.06, 256/65.12

See application file for complete search history.

(56) References Cited

U.S. PATENT DOCUMENTS

| | | | | |
|---|---|---|---|---|
| 2,336,385 A | | 12/1943 | Batcheller | |
| 2,590,929 A | | 4/1952 | Bush | |
| 3,107,900 A | | 10/1963 | Paolo | |
| 3,156,282 A | | 11/1964 | Bedford, Jr. | |
| 3,208,778 A | | 9/1965 | Gordon | |
| 3,212,754 A | | 10/1965 | Revell et al. | |
| 3,278,149 A | | 10/1966 | Brucker | |
| 3,385,567 A | | 5/1968 | Case et al. | |
| 3,498,589 A | | 3/1970 | Murdock | |
| 3,506,243 A | | 4/1970 | Seiler | |
| 3,648,982 A | * | 3/1972 | Sabel et al. | 256/65.05 |

(Continued)

FOREIGN PATENT DOCUMENTS

| | | |
|---|---|---|
| CA | 1035983 | 8/1978 |
| DE | 3404947 A1 | 8/1985 |
| GB | 29939 | of 1898 |

*Primary Examiner*—David P. Bryant
*Assistant Examiner*—Stephen Kenny
(74) *Attorney, Agent, or Firm*—Clayton, Howarth & Cannon, P.C.

(57) ABSTRACT

A fence rail bracket system. The bracket system may include a bracket with an open end for receiving a fence rail, a retention clip for attaching the rail to the bracket, and a cap for covering the open end of the bracket. The bracket may attach to a wall or post and the fence rail may be slid into the open end of the bracket. The retention clip may attach the bracket to the fence rail and prevent the rail from sliding out of the bracket. The cap may be removably attached to the bracket to conceal the hardware used in the system for a more aesthetically pleasing look.

20 Claims, 5 Drawing Sheets

U.S. PATENT DOCUMENTS

| | | | | | |
|---|---|---|---|---|---|
| 4,101,226 | A | | 7/1978 | Parisien | |
| 4,114,861 | A | | 9/1978 | Long | |
| 4,124,198 | A | | 11/1978 | Wong | |
| 4,135,837 | A | | 1/1979 | Suttles | |
| 4,165,944 | A | | 8/1979 | Sunasky | |
| 4,280,686 | A | | 7/1981 | Wack | |
| 4,368,875 | A | | 1/1983 | Weiss et al. | |
| 4,369,953 | A | | 1/1983 | Greiner et al. | |
| 4,616,950 | A | | 10/1986 | Morris | |
| 4,625,948 | A | | 12/1986 | Lustvee | |
| 4,856,252 | A | | 8/1989 | Cornell | |
| 4,919,394 | A | | 4/1990 | Otte et al. | |
| 4,923,176 | A | | 5/1990 | Heinz | |
| 4,958,399 | A | | 9/1990 | Toal et al. | |
| 5,101,540 | A | | 4/1992 | Roof et al. | |
| 5,143,472 | A | | 9/1992 | Reed et al. | |
| 5,186,571 | A | | 2/1993 | Hentzschel | |
| 5,215,290 | A | | 6/1993 | Khalessi | |
| 5,437,433 | A | | 8/1995 | Rezek | |
| 5,441,241 | A | | 8/1995 | McKim | |
| 5,474,279 | A | | 12/1995 | Parisien | |
| 5,544,865 | A | | 8/1996 | Abbaticchio | |
| 5,547,169 | A | | 8/1996 | Russell | |
| 5,564,248 | A | | 10/1996 | Callies | |
| 5,755,431 | A | | 5/1998 | Williams | |
| 5,788,224 | A | | 8/1998 | Platt | |
| 5,795,503 | A | | 8/1998 | Krake | |
| 5,873,671 | A | | 2/1999 | West | |
| 5,938,184 | A | * | 8/1999 | DeSouza | 256/19 |
| 5,964,452 | A | | 10/1999 | Summers | |
| 5,967,498 | A | | 10/1999 | Junell | |
| 5,971,365 | A | | 10/1999 | Pigott et al. | |
| 6,017,019 | A | | 1/2000 | Erwin | |
| 6,029,954 | A | | 2/2000 | Murdaca | |
| 6,039,307 | A | | 3/2000 | De Zen | |
| 6,053,481 | A | | 4/2000 | Scheide | |
| 6,131,358 | A | | 10/2000 | Wise | |
| 6,173,944 | B1 | | 1/2001 | McCarthy | |
| 6,308,937 | B1 | | 10/2001 | Pettit | |
| 6,398,193 | B1 | | 6/2002 | DeSouza | |
| 6,471,192 | B1 | | 10/2002 | Erwin | |
| 6,484,465 | B1 | | 11/2002 | Higgins | |
| 6,698,726 | B1 | * | 3/2004 | Platt | 256/59 |

* cited by examiner

METHOD FOR ATTACHING A FENCE RAIL TO A SUPPORT

This application is a division of U.S. patent application Ser. No. 10/277,721, filed Oct. 21, 2002, entitled "FENCE RAIL CAP BRACKET ASSEMBLY", which is a continuation of U.S. patent application No. 10/138,722, filed May 3, 2002 now abandoned, entitled "FENCE RAIL CAP BRACKET ASSEMBLY," which claims the benefit of U.S. Provisional Application No. 60/288,359, filed May 3, 2001. entitled "FENCE RAIL CAP BRACKET ASSEMBLY" which are hereby incorporated by reference herein in their entireties, including but not limited to those portions that specifically appear hereinafter, the incorporation by reference being made with the following exception: In the event that any portion of the above-referenced applications are inconsistent with this application, this application supercedes said above-referenced applications.

STATEMENT REGARDING FEDERALLY SPONSORED RESEARCH OR DEVELOPMENT

Not Applicable.

BACKGROUND OF THE INVENTION

1. The Field of the Invention

The present invention relates generally to brackets used to secure a horizontal member to a support structure. More particularly, but not necessarily entirely, the present invention relates to a multi-piece fence rail bracket assembly which not only attaches a horizontal member to a support structure, but also securely attaches the horizontal member to the bracket, while preserving the aesthetic quality of the fence system.

2. Description of Related Art

Fence rails are typically attached to a support structure, such as a post or wall, with a bracket or other support member. The bracket typically functions to support the rail. The rail is often not secured to the bracket and the rail is able to slip out of the bracket when stress is placed upon the fence.

Some of the brackets disclosed in the prior art make installation of the fence rails difficult to accomplish. Installation of the fence rail using these prior art brackets is accomplished by first attaching two opposing brackets to opposing fence posts, then placing one end of the rail into one bracket, and bending the rail to force the other end of the rail into the opposing bracket.

Other prior art brackets, such as the fence rail clip disclosed in U.S. Pat. No. 5,788,224, includes a base for the bracket that attaches to the support structure. Installation of this bracket is accomplished by mounting a base to the fence post, then placing the bracket over the rail, and thereafter slidably attaching the bracket and rail to the base. Although this type of bracket system prevents the need to bend the rail to fit it in place, the base only secures a portion of the bracket resulting in less stability. Another disadvantage is that the rail is not fixedly attached to the bracket.

The prior art is also characterized by rail brackets with an open end which makes installation of the rail easier, and wherein the rail is attached to the bracket. However, these brackets are unsightly because the hardware used to attach the rail to the bracket is visible. For example, U.S. Pat. No. 5,547,169 discloses a rail bracket which is open on one end where the rail resides and wherein the rail attaches to the bracket, but the fastener used to attach the rail to the bracket is visible. The visible fasteners are unsightly, exposed to the elements, and create three dimensional features which can snag clothing or collect dirt.

The prior art is thus characterized by several disadvantages that are addressed by the present invention. The present invention minimizes, and in some aspects eliminates, the above-mentioned failures, and other problems, by utilizing the methods and structural features described herein.

The features and advantages of the invention will be set forth in the description which follows, and in part will be apparent from the description, or may be learned by the practice of the invention without undue experimentation. The features and advantages of the invention may be realized and obtained by means of the instruments and combinations particularly pointed out in the appended claims.

BRIEF DESCRIPTION OF THE DRAWINGS

The features and advantages of the invention will become apparent from a consideration of the subsequent detailed description presented in connection with the accompanying drawings in which.

DETAILED DESCRIPTION OF THE INVENTION

Figure 1:
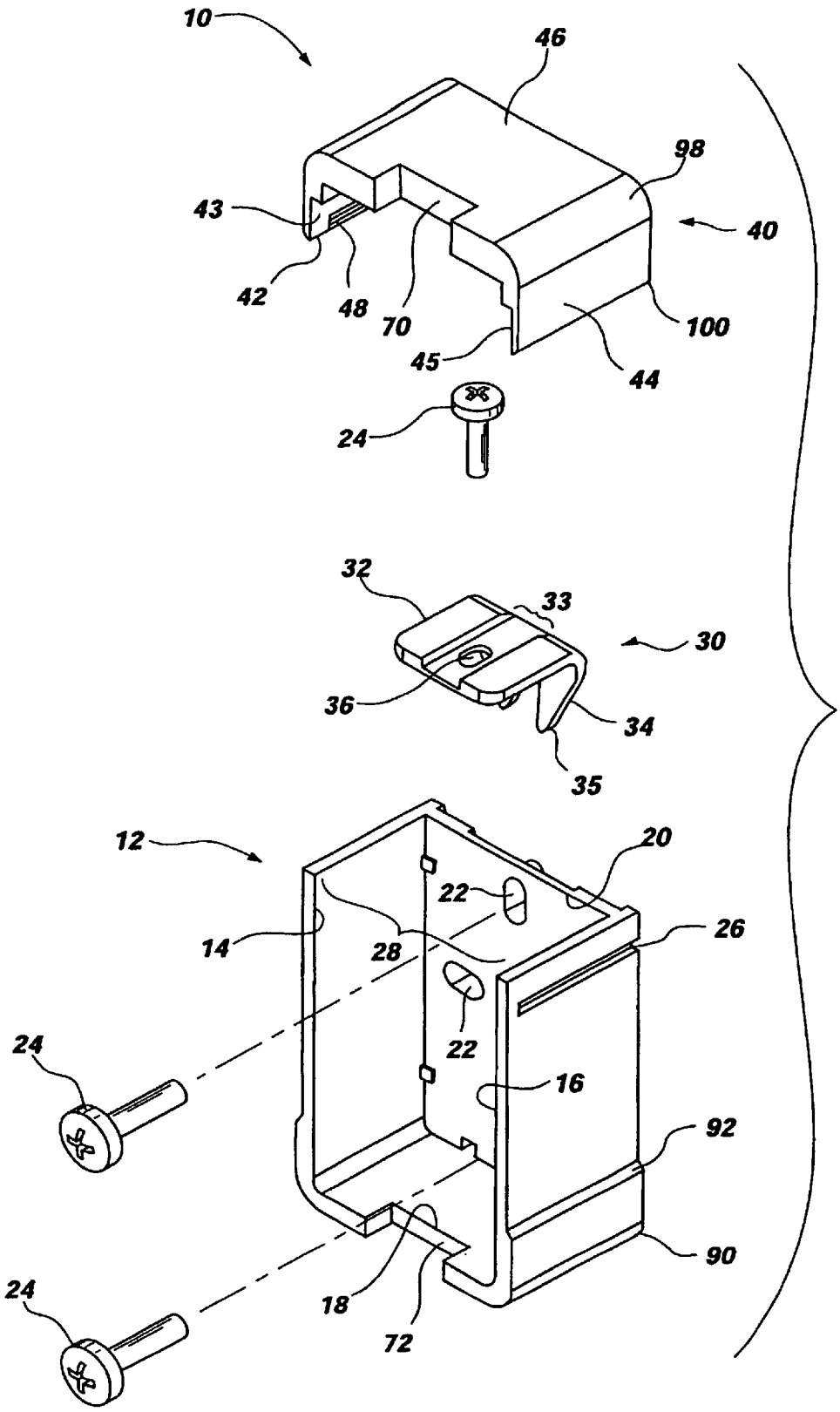
FIG. 1 is an exploded perspective view of the fence rail cap bracket assembly.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Before the present structures and methods for a fence rail bracket system are disclosed and described, it is to be understood that this invention is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present invention will be limited only by the appended claims and equivalents thereof.

The publications and other reference materials referred to herein to describe the background of the invention and to provide additional detail regarding its practice are hereby incorporated by reference herein. The references discussed herein are provided solely for their disclosure prior to the filing date of the present application. Nothing herein is to be construed as a suggestion or admission that the inventors are not entitled to antedate such disclosure by virtue of prior invention.

It must be noted that, as used in this specification and the appended claims, the singular forms "a," "an," and "the" include plural referents unless the context clearly dictates otherwise.

In describing and claiming the present invention, the following terminology will be used in accordance with the definitions set out below.

As used herein, the terms "comprising," "including," "containing," "characterized by," and grammatical equivalents thereof are inclusive or open-ended terms that do not exclude additional, unrecited elements or method steps.

As used herein, "consisting of" and grammatical equivalents thereof exclude any element, step, or ingredient not specified in the claim.

As used herein, "consisting essentially of" and grammatical equivalents thereof limit the scope of a claim to the specified materials or steps and those that do not materially affect the basic and novel characteristic or characteristics of the claimed invention.

Figure 3:
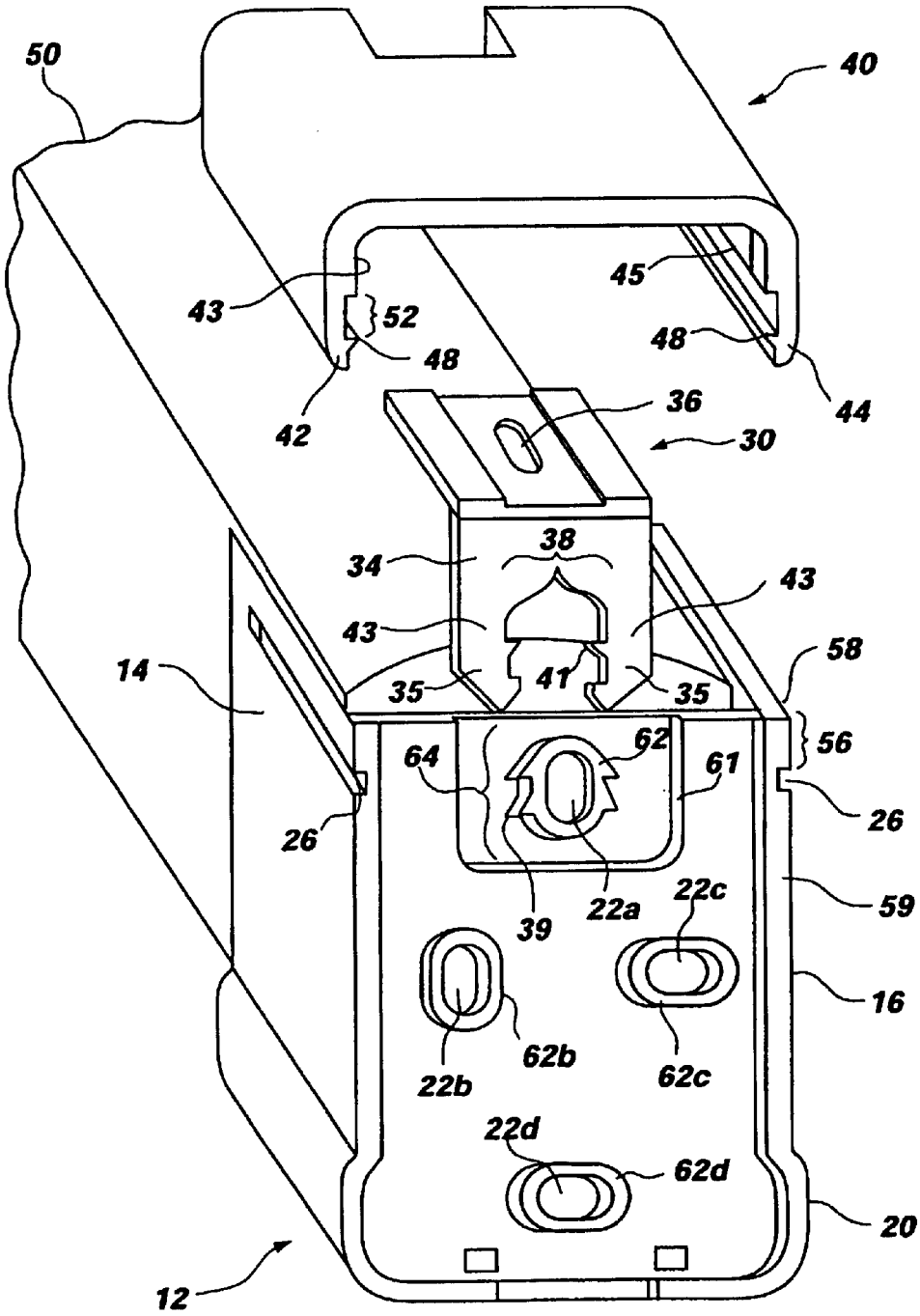
FIG. 3 is a perspective view of the fence rail cap bracket assembly shown in FIG. 1, with the addition of a rail residing in the U-bracket.

Referring now to FIG. 1, there is shown an exploded perspective view of a fence rail cap bracket assembly generally indicated at 10. In one embodiment, the assembly 10 comprises three pieces. The first piece may be a bracket 12, with an open end 28, which may have a general "U" shape (hereinafter U-bracket). In alternative embodiments, the shape of the bracket 12 will be complementary to the contour of the outer-surface of a fence rail, or other horizontal member. Referring again to FIG. 1, the "U" shape of the U-bracket 12 may be defined by a first wall 14, an opposing second wall 16, and a bottom wall 18 which form a rail support. The U-bracket 12 may also have a back wall 20. The back wall 20 of the U-bracket 12 may have holes 22, wherein the holes 22 may have an oval shape. In one embodiment, the U-bracket 12 has four holes 22 (as shown in FIG. 3). The holes 22 may extend through the back wall 20 of the U-bracket 12 and function to receive a fastening means, such as a screw 24, wherein the screws 24 attach the U-bracket 12 to a support structure (not shown), such as a post or wall. The oval shape of the holes 22 allows the U-bracket 12 to expand and contract with the environmental conditions, without interfering with the function of the U-bracket 12. The first wall 14 and the second wall 16 may each have a groove 26, wherein the groove 26 may be located on the outer surface of the first wall 14 and second wall 16. The grooves 26 may extend a majority of the width of said first wall 14 and the second wall 16 parallel to the bottom wall 18, and may be located near the open end 28 of the U-bracket 12.

Figure 2A:
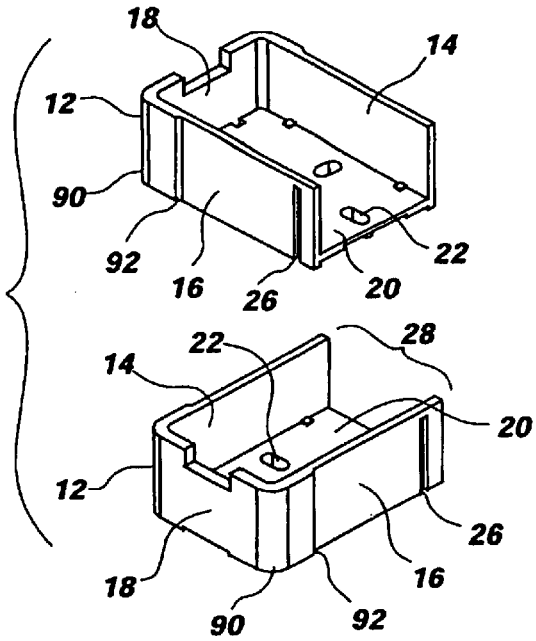
FIG. 2A shows two perspective views of one embodiment of the U-bracket of the fence rail cap bracket assembly shown in FIG. 1.
Figure 2B:
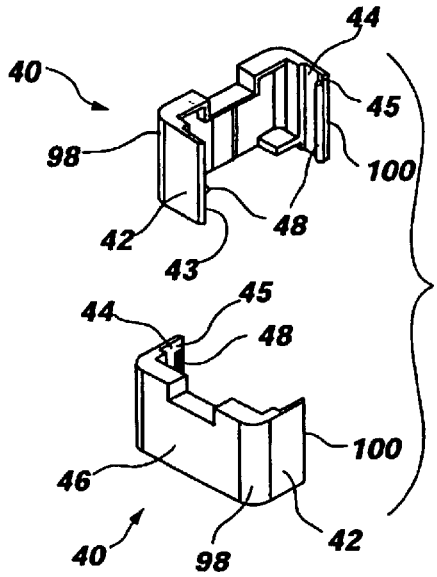
FIG. 2B shows two perspective views of one embodiment of the cap of the fence rail cap bracket assembly shown FIG. 1.
Figure 2C:
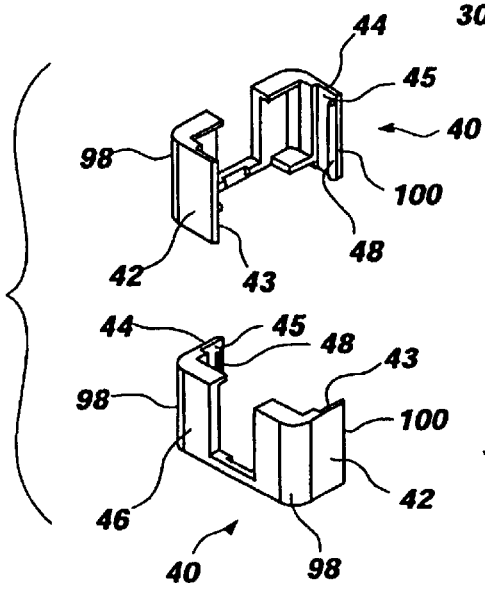
FIG. 2C shows two perspective views of an alternative embodiment of the cap of the fence rail cap bracket assembly shown in FIG. 1.
Figure 2D:
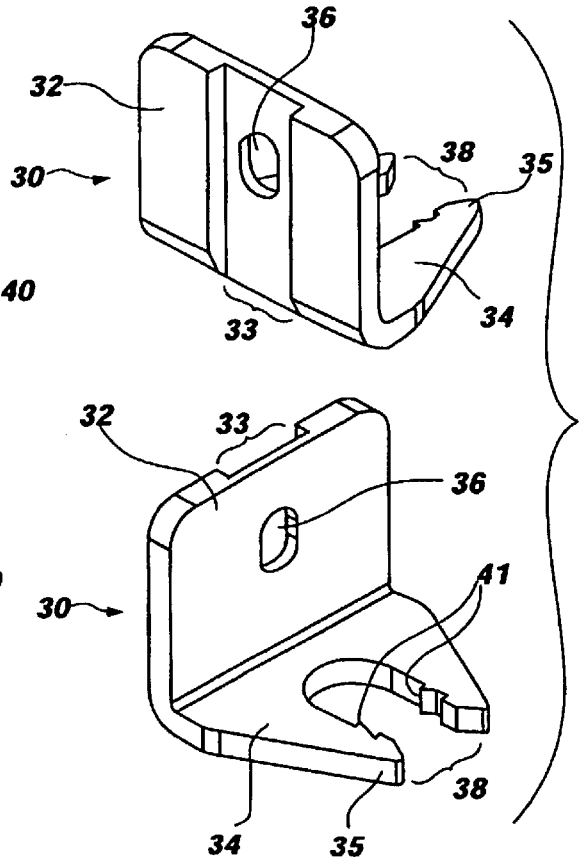
FIG. 2D shows two perspective views of the retention clip of the fence rail cap bracket assembly shown in FIG. 1.

Referring back to FIG. 1, the second piece of the assembly 10 may be a retention clip 30. The retention clip 30 may have a general "L" shape, defined by a first portion 32 and a second portion 34. Referring to now to FIG. 2D, there is shown two perspective views of the retention clip 30 of the fence rail cap bracket assembly 10 of FIG. 1. The first portion 32 may have a hole 36 which may be oval in shape, and which may extend through the first portion 32 and functions to receive a fastening means, such as a screw 24 (shown in FIG. 1). A recessed area 33 may be formed into the first portion 32 around the hole 36. The recessed area 33 functions to prevent the head of a screw 24 (shown in FIG. 1) from projecting above the surface of the first portion 32. The second portion 34 may have an aperture 38 with teeth 41 projecting inwardly from the aperture 38.

Referring now to FIG. 3, there is shown another perspective view of the U-bracket 12, the retention clip 30 and the cap 40, from the opposite side of the assembly 10 as shown in FIG. 1, with the addition of a rail 50 residing the U-bracket 12. The teeth 41 on the retention clip 30 may mesh with the complementary teeth 39 which form a catch on the back wall 20 of the U-bracket 12. The complementary teeth 39 may be positioned on a rear face of the back wall 20, whereas the first wall 14, the second wall 16 and the bottom wall 18 may form support for the rail 50 on the front face of the back wall 20. The retention clip 30 may be slid into position after a rail 50 is placed in the U-bracket 12. The second portion 34 of the retention clip 30 may be slid into the recessed area 64 of the U-bracket 12. The teeth 41 of the retention clip 30 may slide over the complementary teeth 39 on the U-bracket 12. Prongs 35 of the retention clip 30 may have elastic memory which allows the prongs 35 to flex. Once the teeth 41 of the prongs 35 pass over the complementary teeth 39 on the U-bracket, the prongs 35 may flex back to their original position and the teeth 41 on the prongs 35 of the retention clip 30 may mesh with the complementary teeth 39 of the U-bracket 12 such that the teeth 41 thereby engage with the complementary teeth 39 of said U-bracket 12. Therefore, in accordance with the forgoing, the prongs 35 are resilient to enable them to flex, and in addition said prongs 35 possess elastic memory to enable them to flex back to their original position as so described in the forgoing. The retention clip 30 may be attached to a rail 50 or other horizontal member by passing a screw 24 (shown in FIG. 1 ) through the hole 36 of the retention clip 30 and attaching the screw 24 to said rail 50.

Referring again to FIG. 1, the third piece of the assembly 10 may be a cap 40 that fits over the opening 28 on the U-bracket 12 and conceals the retention clip 30, screws 24, and end of the rail 50 (shown in FIG. 3). The cap 40 may have a general "U" shape. Alternative embodiments of the cap 40 will generally have a shape that complements the shape of the bracket 12. The cap 40 may have a first side 42, an opposing second side 44, and a top side 46. Referring to FIG. 3, the inner surface 43 of the first side 42 and the inner surface 45 of the second side 44 of the cap 40 may have ridges 48 which project from the inner surfaces 43 and 45. The ridges 48 may complement the grooves 26 on the outer surface of the first wall 14 and the second wall 16 of the U-bracket 12. The ridges 48 may define the lower boundary of a channel 52 in the cap 40. The channel 52 may receive an upper portion 56, defined on the lower side by the groove 26 of the U-bracket 12 and on the upper side by the top edge 58 of the U-bracket 12.

Referring now to FIG. 3, the upper most hole 22*a* of the U-bracket 12 may be centrally located near the top of the back wall 20 of said U-bracket 12. The upper most hole 22*a* may be located in a recessed area 64, wherein said recessed area 64 surrounds the upper most hole 22*a* and may be defined by a ledge 61. The recessed area 64 functions to receive the retention clip 30, such that said retention clip 30 will slide into the recessed area 64, between the U-bracket 12 and a support post or wall (not shown). An edge 62 of the upper most hole 22*a* may project outwardly from the surface of the recessed area 64 on the back wall 20. The edge 62 of the upper most hole 22*a* may have complementary teeth 39 projecting outwardly from the edge 62. Edges 62*b*, 62*c* and 62*d* of the other holes 22*b*, 22*c* and 22*d*, respectively, may also project outwardly from the surface of the back wall 20. An edge 59 of the back wall 20 of the U-bracket 12 may also project outwardly from the back wall 20.

Figure 4A:
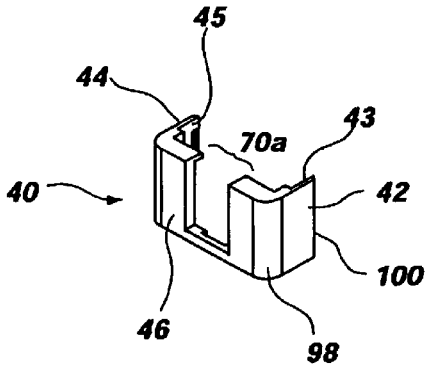
FIG. 4A is a perspective view of an alternative embodiment of the cap as shown in FIG. 2C.
Figure 4B:
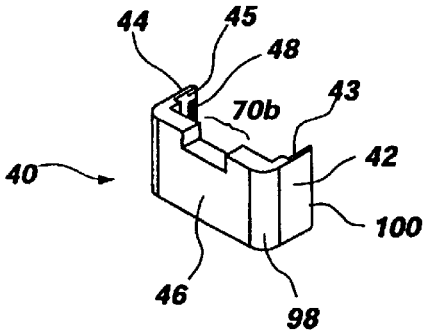
FIG. 4B is a perspective view of another alternative embodiment of the cap as shown in FIG. 2B.

Referring to FIG. 4A and FIG. 4B, there is shown two perspective views of alternative embodiments of the cap 40. The cap 40 may have a mouth 70 molded in the top side 46, on the side of the cap 40 opposite the post or other support structure (not shown). The mouth 70 can be of varying depths. FIG. 4A shows a deep mouth 70*a*, while FIG. 4B shows a shallow mouth 70*b*.

Figure 5A:
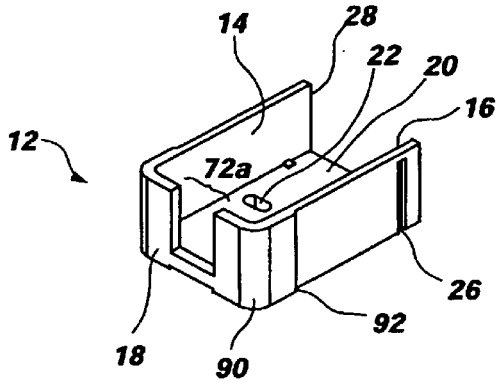
FIG. 5A is a perspective view of an alternative embodiment of the U-bracket.
Figure 5B:
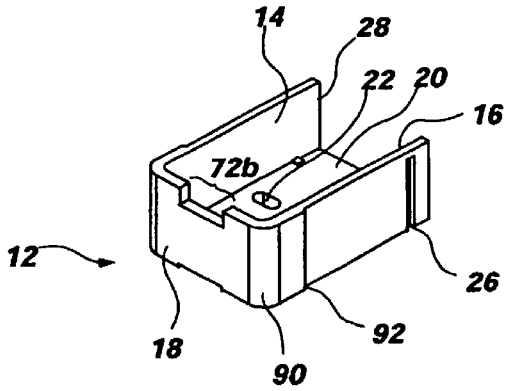
FIG. 5B is a perspective view of another alternative embodiment of the U-bracket as shown in FIG. 2A.

Referring to FIG. 5A and FIG. 5B, there is shown two perspective views of alternative embodiments of the U-bracket 12. The U-bracket 12 may have a mouth 72 formed in the bottom wall 18 on the side of the U-bracket 12 opposite the back wall 20. FIG. 5A shows a deep mouth 72*a*, while FIG. 5B shows a shallow mouth 72*b*. The mouths 70 and 72 of the cap 40 and U-bracket 12, respectively, function to receive pickets or panels of a fence (not shown).

Figure 6A:
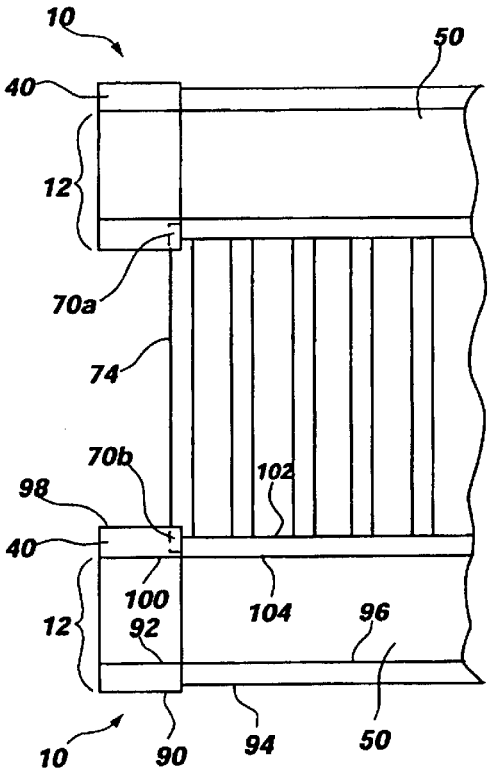
FIG. 6A is a break away, front view of an assembled fence showing the use of one embodiment of the fence rail cap bracket assembly.
Figure 6B:
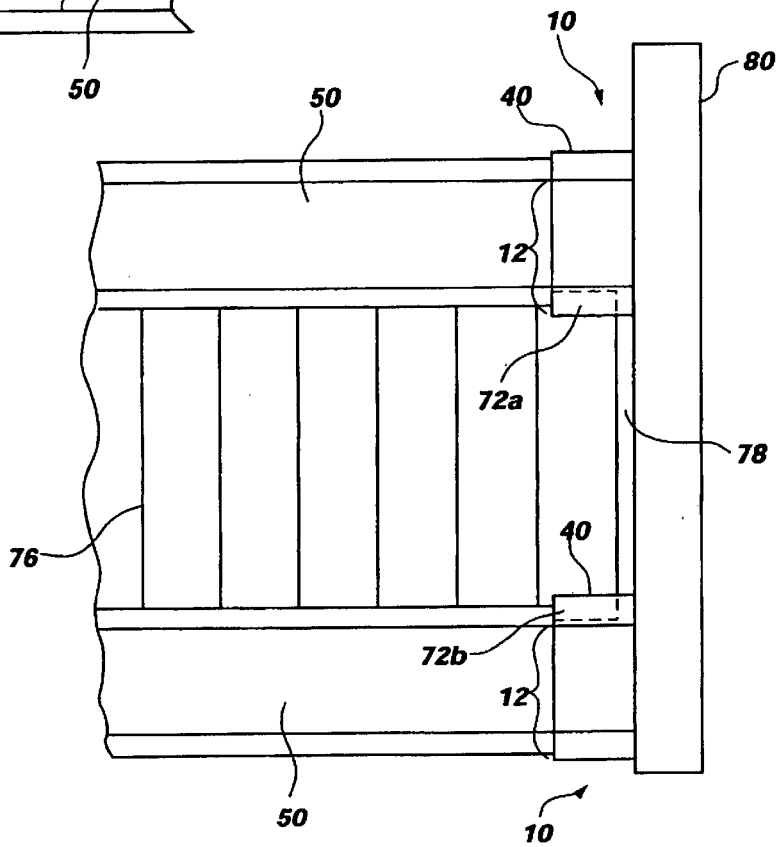
FIG. 6B is a break away, front view of an assembled fence showing the use of another alternative embodiment of the fence rail cap bracket assembly.

Referring to FIGS. 6A and 6B, there is shown a front view of an assembled cap bracket assembly 10 supporting rails 50. FIG. 6A shows a fence with pickets 74 between the rails 50. The shallow mouth 70*a* (shown with dotted lines) of the upper U-bracket 12 receives the picket 74. The shallow mouth 70*b* of the lower cap 40 also receives the picket 74. FIG. 6B shows a fence with planks 76 between the rails 50. The deep mouth 72*a* (shown with dotted lines) of the upper U-bracket 12 receives the plank 76. The deep mouth 72*b* of the lower cap 40 also receives the plank 76. The ability to make the mouths 70 and 72 on the cap 40 and U-bracket 12, respectively, deeper provides more privacy to the fence owner. Referring to FIG. 6B, the deeper the mouths 70 and 72 are formed, the closer the fence plank 76 will be in relation to the post 80, or other support structure. The closer the plank 76 is placed to the post 80, the smaller the gap 78 between the plank 76 and the post 80, and more privacy is provided.

Referring back to FIG. 1, the outer surfaces of the cap 40 and the U-bracket 12 may be formed in an aesthetic manner. The U-bracket 12 may widen near the bottom and a ledge 92 may be formed on the outer surface. The widening of the U-bracket 12 near the bottom may also provide added structural strength for support of the rail 50. The bottom corner 90 of the U-bracket 12 may also be rounded. Referring now to FIG. 6A, the rounded corner 90 of the U-bracket 12 may blend into the sight line of the bottom edge 94 of the rail 50. The outer ledge 92 of the U-bracket 12 may blend into the sight line of a lower groove 96 in the rail 50. Referring back to FIG. 1, the cap 40 may have an upper rounded corner 98 and a rounded bottom edge 100. Referring to FIG. 6A, the upper rounded corner 98 of the cap 40 may blend into the sight line of the upper edge 102 of the rail 50. The rounded bottom edge 100 of the cap 40 may also blend into the sight line of an upper groove 104 of the rail 50.

It will be appreciated that the structure and apparatus disclosed herein is merely one example of a means for attaching a retention clip to a fence rail, and means for attaching a bracket to a support structure, and it should be appreciated that any structure, apparatus or system for attaching which performs functions the same as, or equivalent to, those disclosed herein are intended to fall within the scope of a means for attaching, including those structures, apparatus or systems for attaching which are presently known, or which may become available in the future. Anything which functions the same as, or equivalently to, a means for attaching a retention clip to a fence rail, or means for attaching a bracket to a support structure falls within the scope of these elements.

In accordance with the features and combinations described above, a preferred method of assembling the fence rail cap bracket assembly 10 includes the steps of:

(a) attaching the U-bracket 12 to a wall, post or other support structure (not shown) with screws 24;

(b) sliding a rail 50 into the open end 28 of the U-bracket 12;

(c) attaching the retention clip 30 to the U-bracket 12 by placing the aperture 38 of the retention clip 30 over the edge 62 of the upper most hole 22*a* and forcing the retention clip 30 downward until the teeth 41 of the retention clip 30 snap into meshing engagement with the complementary teeth 39 on the edge 62 of the upper most hole 22*a;*

(d) attaching the retention clip 30 to the fence rail 50 by placing a screw 24 through the hole 36 in the retention clip 30 and affixing the screw 24 into the rail 50; and (e) placing the first side 42 and the second side 44 of the cap 40 over the first wall 14 and second wall 16 of the U-bracket 12, respectively, pressing the cap 40 down on the U-bracket until the ridges 48 of the cap 40 snap into the grooves 26 of the U-bracket.

The U-shape of the bracket 12 makes installation of a fence easier and less laborious. The installer merely attaches the U-shaped bracket 12 to a post or wall with screws 24, then slides the fence rail in the open end 28 of the bracket 12. The installer does not have to place the U-bracket 12 on the rail, then slidably attach the fence rail bracket to an attachment piece as disclosed in U.S. Pat. No. 5,788,224. In addition, applicant's system attaches the rail to the U-bracket 12 with a retention clip 30. The retention clip 30 may be attached to the top side of the rail 50 and to the rear portion of the U-bracket 12 instead of attaching screws 24 through the outside edges of a bracket 12 into the rail 50 as disclosed in the prior art. By attaching the rail 50 to the bracket 12 in this manner, the hardware used to attach the rail 50 to the U-bracket 12 may be hidden from view by the cap 40 and objects may also be prevented from snagging on the hardware. Applicant's method of attachment may also provide more support and strength to the assembled fence.

Applicant's use of a cap 40 in combination with the U-shaped bracket 12 may also provide aesthetic advantages. The cap 40 may cover the retention clip 30, screws 24, and open end 28 of the U-bracket 12. Also, the exterior shape of the cap 40 and U-bracket 12 may be formed to match the sight lines of the fence rail.

Those having ordinary skill in the relevant art will appreciate the advantages provide by the features of the present invention. For example, it is a feature of the present invention to provide a fence rail cap bracket assembly that is simple in design and operation. Another feature of the present invention is to provide a fence rail cap bracket assembly that securely attaches the rail to the bracket. It is a further feature of the present invention, in accordance with one aspect thereof, to provide a fence rail cap bracket assembly that has an aesthetically pleasing look. It is an additional feature of the invention, in accordance with one aspect thereof, to provide a fence rail cap bracket assembly that prevents the rail from sliding out of the bracket when stress is placed upon the fence.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method for attaching a fence rail to a support structure, said method comprising the steps of:

(a) attaching a bracket to the support structure;

(b) attaching a retention clip to the fence rail;

(c) inserting said fence rail within said bracket;

(d) engaging the retention clip with the bracket to attach the fence rail to the bracket; and (e) placing a cap on the bracket to cover the retention clip.

2. The method of claim 1, wherein step (a) comprises inserting at least one screw through said bracket into the support structure.

3. The method of claim 1, wherein step (b) comprises attaching said retention clip on an end of said fence rail.

4. The method of claim 1, wherein step (b) further comprises inserting a screw through said retention clip and said fence rail.

5. The method of claim 1, wherein step (c) comprises inserting said fence rail within an opening defined by a plurality of walls of said bracket.

6. The method of claim 1, wherein step (d) comprises engaging the retention clip with a catch disposed on said bracket.

7. The method of claim 6, wherein step (d) further comprises inserting said catch between resilient prongs of said retention member.

8. The method of claim 7, wherein step (d) further comprises engaging at least one tooth on said resilient prongs with a complementary tooth on said catch.

9. The method of claim 1, wherein step (e) comprises inserting at least one ridge formed on said cap within at least one groove formed on said bracket.

10. A method for attaching a fence rail to a support structure, said method comprising the steps of:

(a) forming a bracket having a back wall, said back wall having a front face and an opposing rear face, said back wall further comprising a rail support extending from said front face of said back wall for receiving said fence rail;

(b) attaching said bracket to said support structure such that said rear face faces said support structure;

(c) attaching a retention clip to the fence rail; and (d) inserting said fence rail in said rail support such that said retention clip resides between said rear face and said support structure to attach said fence rail to said bracket.

11. The method of claim 10, wherein step (b) comprises inserting at least one fastener through said back wall.

12. The method of claim 10, wherein step (c) comprises inserting at least one fastener through said retention clip.

13. The method of claim 10, further comprising step (e) engaging at least one resilient prong disposed on said retention member with a catch disposed on said rear face of said back wall.

14. The method of claim 10, further comprising (f) placing a cap on said bracket to cover said retention clip.

15. The method of claim 14, further comprising inserting at least one ridge formed on said cap within at least one groove formed on said bracket.

16. The method of claim 13, further comprising engaging at least one tooth on said at least one resilient prong with a complementary tooth on said catch.

17. The method of claim 13, further comprising engaging two resilient prongs disposed on said retention member with said catch.

18. The method of claim 12, further comprising recessing said fastener beneath a surface of said retention clip.

19. The method of claim 10, wherein step (a) further comprises forming said rail support of a plurality of walls.

20. A method for attaching a fence rail to a support structure, said method comprising the steps of:

(a) attaching a bracket to the support structure, said bracket having a back wall, said back wall having a front face and an opposing rear face such that said rear face faces said support structure;

(b) attaching a retention clip to the fence rail;

(c) inserting said fence rail within said bracket;

(d) engaging the retention clip with the bracket to attach the fence rail to the bracket; and (e) placing a cap on the bracket to cover the retention clip;

wherein step (a) comprises inserting at least one screw through said bracket into the support structure;

wherein step (b) comprises attaching said retention clip on an end of said fence rail;

wherein step (b) further comprises inserting a screw through said retention clip and said fence rail;

wherein step (c) comprises inserting said fence rail within an opening defined by a plurality of walls of said bracket;

wherein step (d) comprises engaging the retention clip with a catch disposed on said rear face of said bracket;

wherein step (d) further comprises inserting said catch between resilient prongs of said retention member;

wherein step (d) further comprises engaging at least one tooth on said resilient prongs with a complementary tooth on said catch; and wherein step (e) comprises inserting at least one ridge formed on said cap within at least one groove formed on said bracket.

* * * * *